US007444095B2

(12) United States Patent
Tanaka

(10) Patent No.: US 7,444,095 B2
(45) Date of Patent: Oct. 28, 2008

(54) IMAGE FORMING APPARATUS AND PRINTING CONTROL METHOD THEREFOR

(75) Inventor: Koichi Tanaka, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 162 days.

(21) Appl. No.: 11/374,005

(22) Filed: Mar. 14, 2006

(65) Prior Publication Data

US 2006/0210297 A1 Sep. 21, 2006

(30) Foreign Application Priority Data

Mar. 15, 2005 (JP) ..... 2005-073507
Mar. 15, 2005 (JP) ..... 2005-073508
Mar. 15, 2005 (JP) ..... 2005-073509

(51) Int. Cl.
*G03G 15/00* (2006.01)

(52) U.S. Cl. ..... 399/82; 399/364; 399/392

(58) Field of Classification Search ..... 399/82, 399/85, 364, 374, 392, 401
See application file for complete search history.

(56) References Cited

FOREIGN PATENT DOCUMENTS

JP 7-271508 10/1995
JP 09216431 A * 8/1997
JP 2004-279449 10/2004
JP 2004-279451 10/2004
JP 2004279449 A * 10/2004

* cited by examiner

*Primary Examiner*—David M. Gray
*Assistant Examiner*—Kristofferson Service
(74) *Attorney, Agent, or Firm*—Smith, Gambrell & Russell, LLP

(57) ABSTRACT

The present invention is an image forming apparatus having no two-sided printing mechanism in which, by setting a front side printed paper sheet in a manual paper feed section, the paper sheet is taken from the manual paper feed section and a back side printing is executed. At this moment, when a paper detecting switch 24 detects presence of a paper sheet on a manual paper feed tray 23 at the end of the front side printing, a message meaning to remove the paper sheet and thereafter to set the front side printed paper sheet is given. Whether the paper sheet is removed or not is detected according to a change-over of the paper detecting switch 24, and the back side printing is executed after the paper sheet is removed and the front side printed paper sheet is set. As a result, erroneous back side printing on an improper paper sheet can be prevented and a two-sided printing can be correctly executed.

8 Claims, 5 Drawing Sheets

IMAGE FORMING APPARATUS AND PRINTING CONTROL METHOD THEREFOR

BACKGROUND OF THE INVENTION

1. Field of the Invention

The present invention relates to an image forming apparatus such as a printer and a copying machine, and a printing control method therefore.

2. Description of Related Art

Image forming apparatus having a two-sided printing mechanism for automatically printing images on both of the front and back sides of a supplied paper sheet and discharging the image printed paper sheet to a discharge position is conventionally known. In the case that printing is executed in a two-sided printing mode in such a kind of image forming apparatus (so-called a two-sided printing apparatus), a paper sheet set in a paper feed position such as a paper feed cassette, a manual paper feed tray or the like is fed to an image forming section, and an image is printed on one surface (the first surface or the front side) of the paper sheet. Thereafter the paper sheet is reversed in the apparatus and fed to the image forming section again and an image is printed on the remaining one surface (the second surface or the back side) of the paper sheet. The paper sheet with images printed on both of the front and back sides (the first and second surfaces) thereof in such a manner is discharged to a discharge position such as a discharge tray outside the apparatus and thereby the two-sided printing can be achieved by a single paper feed from the paper feed position (see, for example, Japanese Unexamined Patent Publication No. 7-271508).

However, in order to realize such a two-sided printing mechanism as abovementioned, a device (so-called a switch-back device) for reversing the front side (the first surface) printed paper sheet in the image forming apparatus is required, and thereby the whole structure of the image forming apparatus grows in size and the manufacturing cost thereof becomes high.

Therefore, it is thought that the two-sided printing is executed using an image forming apparatus having no two-sided printing mechanism (so-called a one-sided printing machine). In other words, printing images on two sides of a paper sheet can be achieved by the steps of feeding a paper sheet set in the paper feed position to the image forming section, printing an image on one side (the first surface or front side) of the paper sheet, thereafter discharging the printed paper sheet to the discharge position outside the apparatus, feeding the paper sheet to the image forming position in response to a user's setting again the paper sheet in the paper feed position, and printing an image on the other side (the second surface or back side) of the paper sheet (see, for example, Japanese Unexamined Patent Publication Nos. 2004-279499 and 2004-279451).

In two-sided printing methods using a so-called one-sided printer such as those disclosed in Japanese Unexamined Patent Publication Nos. 2004-279449 and 2004-279451, "a manual paper feed two-sided printing mode" is provided for facilitating the two-sided printing in some cases. Taking of such a printer provided with "a manual paper feed two-sided printing mode" as an example, in the manual paper feed two-sided printing mode, a message meaning "Set the printed paper sheet on the manual paper feed tray and then press the OK button" is pop-up displayed in a user's personal computer connected to the printer after an image is printed on one side of a paper sheet. That is, processes and operations to be executed by the user are informed to the user.

However, such a conventional apparatus has a disadvantage that, if other paper sheet than the printed paper sheet has been set on the manual paper feed tray when the user erroneously presses the OK button, the conventional printer starts feeding the paper from the manual paper feed tray and executes the back side printing no matter whether it is the front side printed paper sheet or not.

Further, such a conventional apparatus has another disadvantage that, after the front side printing ends, according to the informed processes/operations, the user has to go to the printer and set the front side printed paper sheet on the manual paper feed tray, then return to his (her) seat again and click the OK button of the personal computer. Thus, the user is compelled to execute inefficient operations.

Further, such a conventional apparatus has a further disadvantage that, in the manual paper feed two-sided printing mode, if the user fails to set the front side printed paper sheet on the manual paper feed tray after the front side printing, the printer remains in the manual paper feed two-sided printing mode and cannot accept or execute any printing demand (another job) transmitted from another personal computer and the like.

Furthermore, such a conventional apparatus has a disadvantage that, if it is so arranged that another job is acceptable in the two-sided printing mode, sometimes the two-sided printing cannot be correctly executed and erroneous printing is done.

SUMMARY OF THE INVENTION

The present invention has been made with such a background. First object of the present invention is to provide an image forming apparatus having no two-sided printing mechanism, namely, a so-called one-sided image forming apparatus so improved that a user can more easily and suitably execute the two-sided printing.

Second object of the present invention is to provide an image forming apparatus having no two-sided printing mechanism (a so-called one-sided image forming apparatus) which informs proper operation procedures to a user and can execute preferable two-sided printing in response to the user's operation made according to the information.

Third object of the present invention is to provide an image forming apparatus having no two-sided printing mechanism which informs proper assisting actions to do to a user and can execute the preferable two-sided printing in response to the user's actions made according to the information.

Fourth object of the present invention is to provide an improved two-sided printing method in an image forming apparatus having no two-sided printing mechanism.

The present invention is an image forming apparatus having a manual paper feed section comprising a front side printing executing means which executes the printing on one side of a paper sheet in response to an inputted two-sided printing instruction to print on the front and back sides of the paper sheet and discharges the one side printed paper sheet to the outside of the apparatus, a paper detecting means for detecting the presence or absence of a paper sheet in the manual paper feed section, an informing means for giving an information to remove the paper sheet from the manual paper feed section in response to the paper detecting means detecting the presence of the paper sheet at least when the printing on one side of the paper sheet by the front side printing executing means ends, and a back side printing executing means which takes a paper sheet from the manual paper feed section, executes the printing on the other side of the paper sheet and discharges the printed paper sheet to the outside of the apparatus, in response to the paper detecting means once detecting the absence of the paper sheet and thereafter detecting the presence of the paper sheet after the information is given by the information means.

According to the present invention, in an image forming apparatus having no two-sided printing mechanism (a so-called one-sided image forming apparatus), if any paper sheet irrelevant to the two-sided printing is present in the manual paper feed section when the one side (the front side) printing ends, "the presence of an irrelevant paper sheet" is detected and proper operation procedures are informed to the user so that the paper sheet can be removed and the front side printed proper paper sheet to be used for the back side printing can be set in the manual paper feed section.

The user can execute the operations according to the informed operation procedures. As a result, the back side printing can be executed properly on the back side of the front side printed paper sheet.

Further, even if any paper sheet irrelevant to the back side printing is left in the manual paper feed section, it is detected and erroneous back side printing is not executed, and therefore, erroneous printing can be surely prevented.

DETAILED DESCRIPTION OF PREFERRED EMBODIMENTS

Now preferred embodiments of the present invention will be described in the following with reference to the appended drawings.

Figure 1:
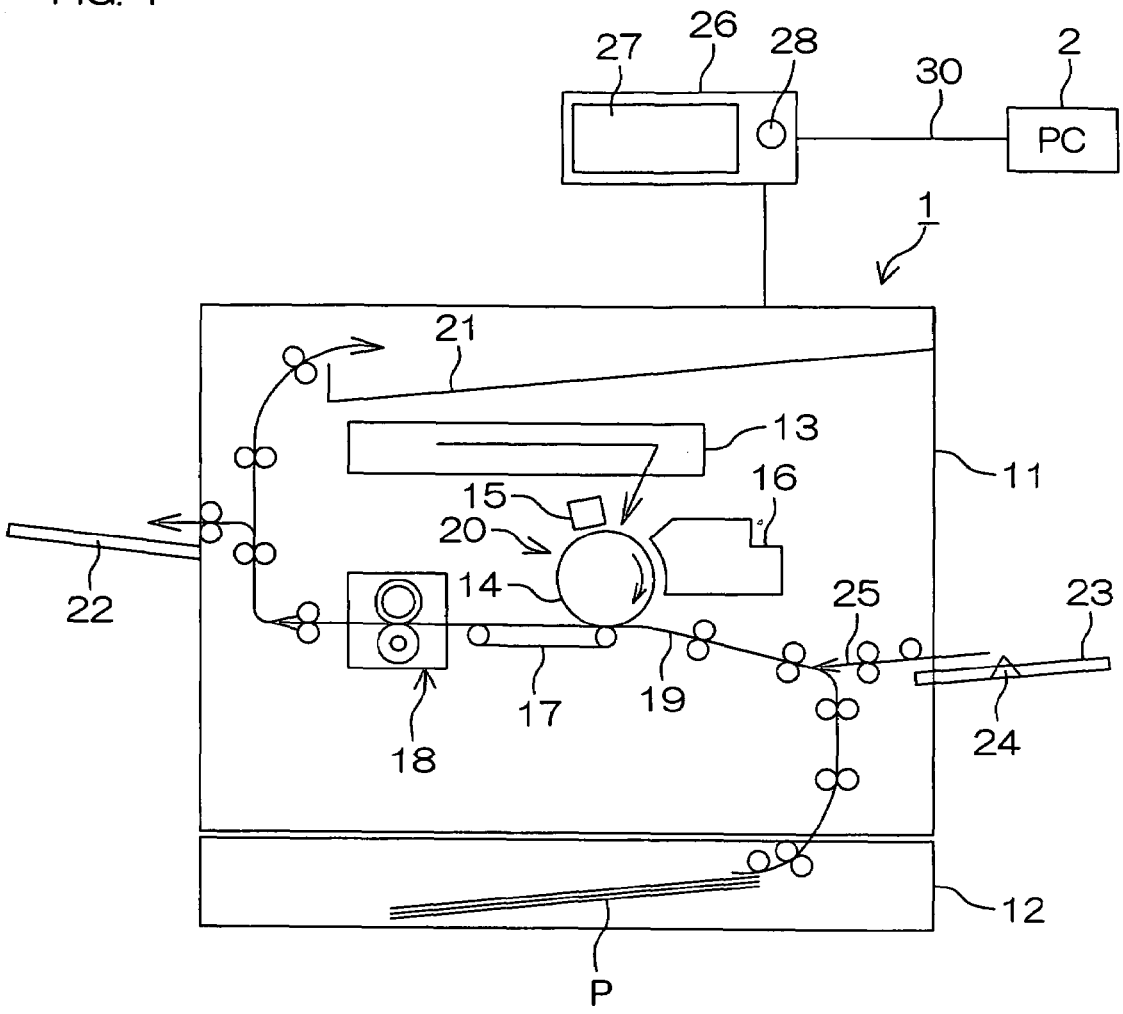
FIG. 1 is a sectional view showing a structure of a printer as an example of an image forming apparatus according to an embodiment of the present invention.

FIG. 1 is a sectional view showing a structure of a printer 1 as an example of an image forming apparatus, in which the printer 1 and a personal computer 2 are connected to each other by an arbitrary communication circuit network (for example, LAN) 30.

An outline of the printer 1 is defined by a housing 11, and a paper feed cassette 12 is provided, for example, below the housing 11.

Contained within the housing 11 are so-called an image forming section 2 comprising an LSU (laser scanning unit) 13, a photoconductor drum 14, a main charger 15, a developing device 16, a transfer belt 17 and the like, and a fixing device 18 for fixing toner images transferred on a paper sheet. A paper sheet P contained in the paper feed cassette 12 is conveyed through a conveying path 19 and passes through the image forming section 20 and the fixing device 18, whereby an image is printed on the paper sheet. Then, the printed paper sheet is discharged onto an upper paper discharge tray 21 or a side paper discharge tray 22 exposed or projected outside the machine. It can be changed over by the operation on a display/operation panel 26 whether the printed paper sheet is discharged onto the upper discharge tray 21 or the side discharge tray 22.

On the side wall of the housing 11, a manual feed tray 23 is provided as a preliminarily fixed paper feed section. The manual feed tray 23 is provided with a paper detecting switch 24 for detecting whether a set paper sheet is present or not. The paper sheet set on the manual feed tray 23 is taken into the conveying path 19 through a paper feed path 25. While the paper sheet is passing through the conveying path 19, a toner image is transferred onto the upper surface of the paper sheet by the image forming section 20, and the transferred toner image is fixed by the fixing device 18 thereby to complete printing. Then, the printed paper sheet is discharged onto the upper discharge tray 21 or the side discharge tray 22.

The housing 11 is provided with the display/operation panel 26. The display/operation panel 26 is provided with a display section 27 and an operation button (OK button) 28.

Further, the printer 1 is connectable to the user's personal computer 2 through a predetermined connecting cable or the circuit network 30 such as a LAN, so that according to printing data and a printing instruction (for example, a two-sided printing instruction) inputted from the personal computer 2, the printer 1 can process the printing data.

Figure 2:
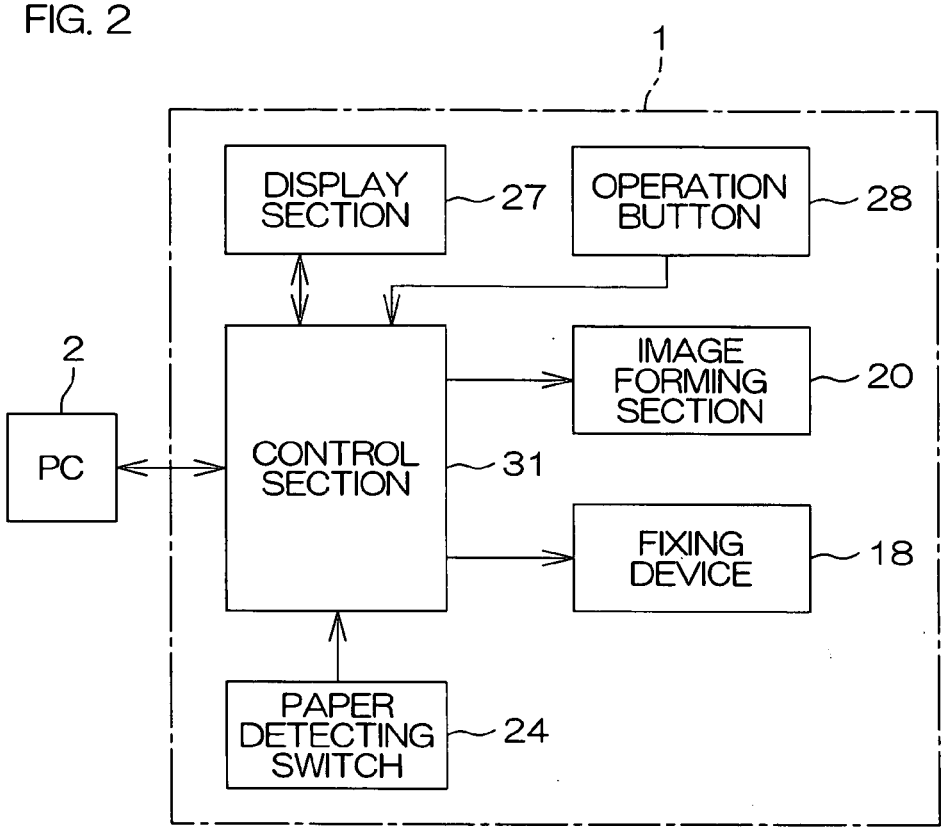
FIG. 2 is a block diagram of control components of the printer and the personal computer of FIG. 1.

FIG. 2 is a block diagram of the personal computer 2 and control components of the printer 1 of FIG. 1. The printer 1 has a control section 31 constituted by a CPU and the like as a control center, to which the display section 27, the operation button 28 and the paper detecting switch 24 are connected. The control section 31 controls driving of the image forming section 20 and fixing device 18. Further, printing data and a two-sided printing instruction can be given to the control section 31 from the personal computer 2. Furthermore, the control section 31 can output information signals and the like to the personal computer 2, and the personal computer 2 can pop-up display information data according to the information signals.

Figure 3:
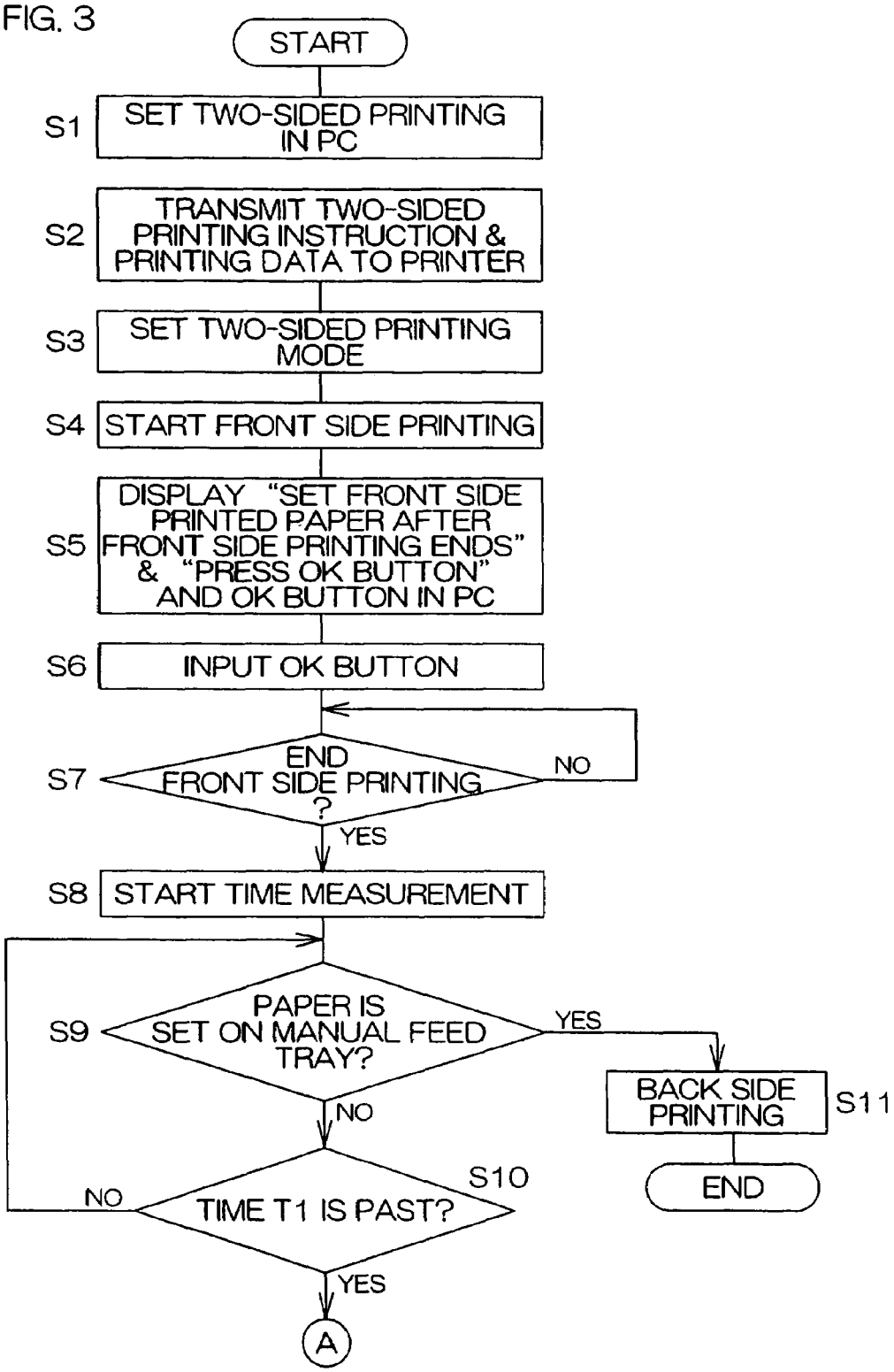
FIGS. 3 and 4 are a flow chart showing control operations in the block diagram of the control components of FIG. 2.
Figure 4:
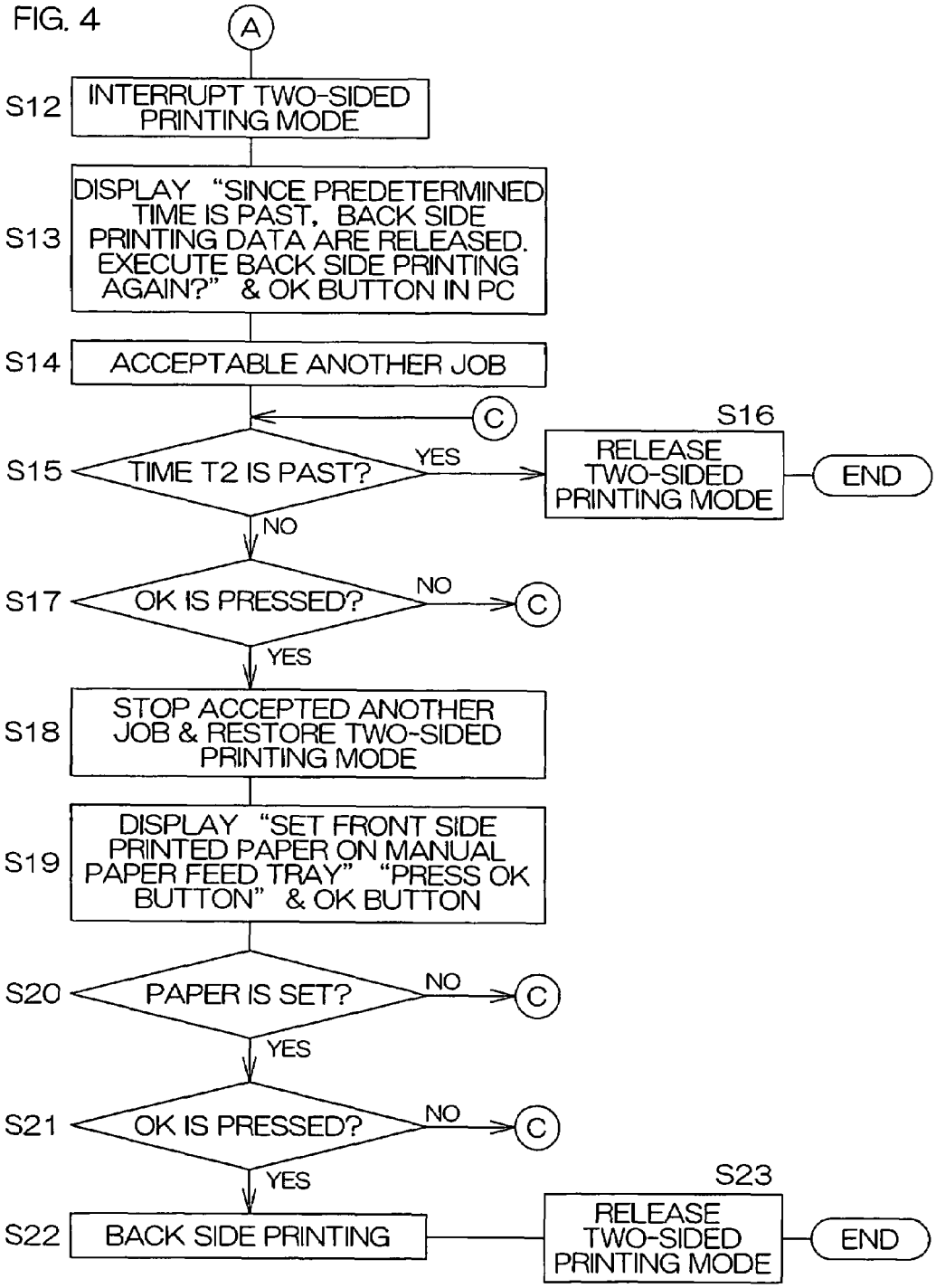

FIGS. 3 and 4 are flow charts showing an example of control operations in the block diagram of control components of FIG. 2. Now, operation procedures of two-sided printing executed in the printer 1 of this embodiment will be described in the following according to the flows of FIGS. 3 and 4 with reference to FIGS. 1 and 2.

First, a user sets the two-sided printing in the personal computer 2 (step S1). Setting of the two-sided printing includes specifying printing data to be given to the printer 2, making an instruction to print on both of the front and back sides of a paper sheet and the like. After setting the two-sided printing in the personal computer 2, the instruction of the two-sided printing and the printing data are transmitted from the personal computer 2 to the printer 1 (step S2).

After receiving the instruction of the two-sided printing and the printing data transmitted at step S2, the printer 1 sets a two-sided printing mode (step S3), not to accept any other printing than the printing according to the received printing data.

Then, in the two-sided printing mode, the printer 1 starts a front side printing in which it prints front side printing data among the received printing data on the paper sheet and discharges the printed paper sheet to the outside of the apparatus (step S4).

Further, the printer 1 transmits an information signal to the personal computer 2. After receiving the information signal, the personal computer 2 displays an massage meaning "After the front side printing ends, set the front side printed paper sheet on the manual paper feed tray. If you understand this, press the OK button" and at the same time displays an OK button (step S5).

The user operating the personal computer 2 confirms the message at step S5 and then press or click the displayed OK button. Thereby, an OK signal indicating that the user approves to perform a predetermined auxiliary operation is given to the printer 1 (step S6).

The printer 1 waits the ending of the front side printing (step S7), and starts time measurement at the ending time of the front side printing as a starting point using a time measuring means (which may be, for example, a software timer realized by the control section 31, or a hardware timer for the time measurement may be provided in the control section 31) (step S8). Then, the printer 1 judges whether the front side printed paper sheet is set on the manual paper feed tray 23 or not (step S9), and also judges whether the time measuring means completes measuring a time T1 as a predetermined first time (step S10). The time T1 can be, for example, a time of about 5 minutes.

When the front side printed paper sheet is set on the manual paper feed tray 23 by the user before the time measuring means completes measuring the time T1, the paper detecting switch 24 detects it. Therefore, according to the paper sheets being set on the manual paper feed tray 23, the printer 1 takes the paper sheets one by one therein, executes on the paper sheet the back side printing in which the back side is printed data among the printing data transmitted at step S2, and discharge the back side printed paper sheet to the outside of the apparatus (step S11).

On the other hand, when the user fails to set the front side printed paper sheet on the manual paper feed tray 23 before the time measuring means completes measuring the time T1, the program proceeds to step S12, where the printer 1 interrupts the two-sided printing mode and changes the state thereof to one in which the printer 1 can print other data than the printing data transmitted at step S2 (step S12). Further, an information signal is transmitted from the printer 1 to the personal computer 2, so that a massage "The front side printing ends according to the two-sided printing instruction, but a predetermined time is over with no printed paper sheet being set on the manual paper feed tray, and so the back side printing data of the transmitted printing data is temporarily released. If you carry out the back side printing again, press the OK button" and an OK button are displayed on the personal computer 2 (step 13).

If the user carelessly fails to set the front side printed paper sheet on the manual paper feed tray 23, for example, the user confirms this message and presses the OK button.

Meanwhile, since the printer 1 interrupts the two-sided printing mode as described at step S12, the printer 1 can accept and carry out another job (other printing data) (step S14). Therefore, when an OK button pressing signal is not transmitted from the personal computer 2, the printer 1 accepts another job and carries out a printing process of the job. Thereby, such a trouble can be prevented that, when a user uses the printer 1 and carelessly fails to set a paper sheet for the back side printing, another user cannot use the printer 1.

After printer 1 interrupts the two-sided printing mode at step S12, when the printer 1 does not receive any signal indicating that the user presses the OK button before a time T2 as a predetermined second time is over, the printer 1 releases the two-sided printing mode (step S16). When the two-sided printing mode is released, the printing data transmitted to the printer 1 at step S2 are deleted from the printer 1 and the unexecuted back side printing cannot be performed. So, the printer 1 can freely perform operations for another job thereafter.

The time T2 detected at step S15 is preferably set to be, for example, about 30 minutes. In this embodiment, since the time measuring means starts measuring time at step S8, when no signal for executing the back side printing is inputted from the user at step S15 during about 35 minutes after the ending of the front side printing, the two-sided printing mode is released (step S16).

As described above, since the two-sided printing mode is interrupted at step S12, the printer 1 is not inoperative but can accept another job and execute printing operations of the another job for about 30 minutes from the time about 5 minutes are passed after the ending of the front side printing to the time about 35 minutes are passed thereafter. Therefore, such a trouble can be prevented that the printer 1 is occupied by a particular personal computer (user) though it is not executing any printing operation.

On the other hand, when the user presses the OK button of the personal computer 2 before the time measuring means completes measuring the time T2, this signal is given to the printer 1 (YES at step S17) and the printer 1 stops executing operations of the another job which it has accepted while the two-sided printing mode is being interrupted and restores the two-sided printing mode (step S18). Then, an information signal is transmitted to the personal computer 2 so that the personal computer 2 can display again the message meaning "Set the front side printed paper sheet on the manual paper feed tray 23. If you understand this, press the OK button" and at the same time display an OK button. According to this information signal, the personal computer 2 displays the abovementioned message and the OK button (step S19).

The printer 1 judges whether the paper sheet is set on the manual paper feed tray 23 (step S20) and whether the OK button is pressed (step S21).

Then, when the front side printed paper sheets are set on the manual paper feed tray 23 and the OK button is pressed, the printer 1 takes therein the paper sheet from the manual paper feed tray 23 one by one, and executes the back side printing on the paper sheet according to the printing data transmitted at step S2 (step S22).

After the back side printing is finished, the two-sided printing mode is released (step S23).

In the abovementioned description of this embodiment, such an arrangement is described that various messages and the OK button are displayed only on the personal computer 2, but the messages and the OK button may be displayed simultaneously also on the display section 27 of the printer 1 in addition to the personal computer 2. In this case, the printer 1 may be so arranged as to execute the abovementioned control operation when the OK button of the printer 1 is pressed, instead of the OK button displayed on the personal computer 2.

Further, in the abovementioned embodiment, the personal computer 2 is connected to the printer 1 and a two-sided printing instruction and printing data are transmitted from the personal computer 2 to the printer 1.

However, even when the printer 1 is, for example, a copying machine and the personal computer 2 is not connected thereto, the abovementioned control operation can be applied. That is, when the printing control method according to this invention is applied to a case where the image forming apparatus is a copying machine to be used as a single machine, and a first user gives an instruction to execute a two-sided printing according to a manuscript read in the copying machine, starts the front side printing and thereafter leaves the copying machine, a second user can use conveniently the copying machine while the two-sided printing of the first user does not end and the two-sided printing mode of the copying machine is interrupted.

Further, it is convenient that, as long as the predetermined time T2 is not over, the first user can restore the two-sided printing mode and smoothly execute the two-sided printing according to the data already read out.

In the abovementioned embodiment, the manual paper feed tray 23 is described as an example of a paper feed section for setting the front side printed paper sheet, but a specified paper feed section for setting the front side printed paper sheet may be provided.

In the control procedures described with reference to FIGS. 3 and 4, the time measuring means measures time in two steps of the times T1 and T2 (see steps S10 and S15), and different control operations are executed according to whether the time T1 or T2 is over or not.

However, instead of this, it can be so arranged that, when the user does not set the front side printed paper sheet on the manual paper feed tray 23 before the time measuring means has completed measuring the predetermined time at step S10, the two-sided printing mode is immediately released instead of interrupting the two-sided printing mode.

That is, it can be so arranged that, in FIGS. 3 and 4, the steps after step S12 are not executed and the releasing of the two-sided printing mode at step S16 is executed according to the judgment that the predetermined time is over at step S10. Thereby, such a trouble can be prevented that a particular user occupies the printer 1 for a long time with the two-sided printing being half-finished.

Figure 5:
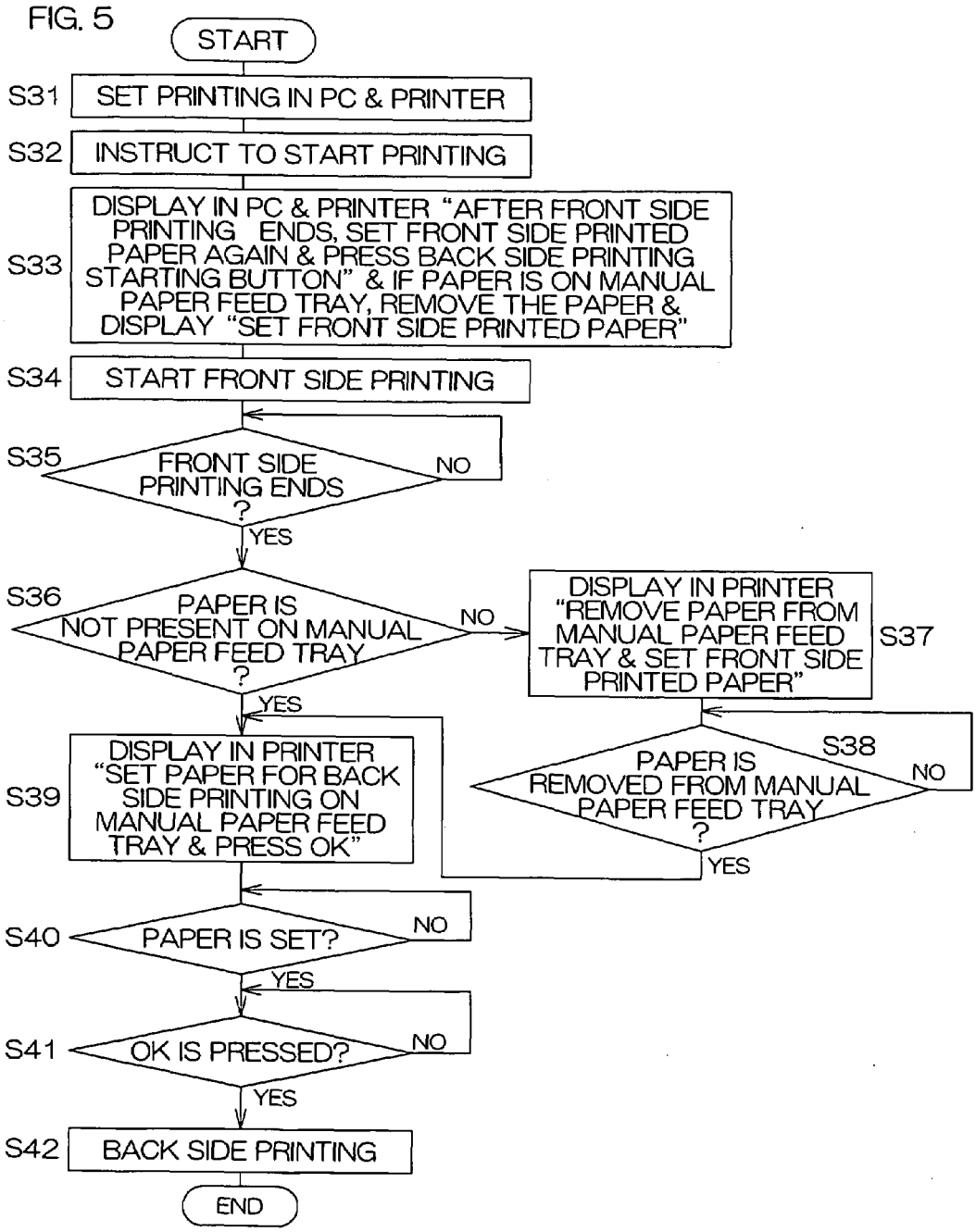
FIG. 5 is a flow chart showing other control operations in the block diagram of the control components of FIG. 2.

FIG. 5 is a flow chart showing another example of control operations in the block diagram of the control components of FIG. 2. Now, another procedures of the two-sided printing in the printer 1 of this embodiment than the abovementioned one shown in FIGS. 3 and 4 will be described according to the flow of FIG. 5 and with reference to FIGS. 1 and 2.

First, a printing setting is made using the display/operation panel 26 of the printer 1 or the personal computer 2 (step S31). The printing setting indicates to set the printing the printing data given to the printer 1 on both of the front and back sides of a paper sheet at printing. Usually, this printing setting can be made using the display panel of the personal computer 2 and the printing setting is transmitted to the printer 1 together with the printing data. However, such an arrangement is also possible that after only the printing data or both of the printing data and the printing setting are given to the printer 1, the printing setting can be made or the printing setting given from the personal computer 2 can be changed and set again using the display/operation panel 26 of the printer 1.

After the printing setting is made using the personal computer 2 or the printer 1, an instruction for starting printing is inputted (step S32). This instruction for starting printing can be given from the personal computer 2 to the printer 1 by pressing a predetermined button, by clicking a predetermined icon of the personal computer 2 or the like, or by pressing the operation button 28 on the display/operation panel 26 of the printer 1.

After the instruction for starting printing is inputted, a massage meaning "After the front side printing ends, reset the front side printed paper sheet and press the back side printing starting button" is displayed on the display section 27 of the printer 1 and the display panel of the personal computer 2. At this time, when it is detected by the paper detecting switch 24 that paper sheet are present on the manual paper feed tray 23, a message meaning "Remove the paper sheet from the manual paper feed tray 23 and set the front side printed paper sheet thereon" is displayed (step S33).

The display control at step S33 is not necessarily required but is only for confirmation, and so it may be skipped.

Then, first, the front side printing is started (step S34). In the front side printing, paper sheets stored in the paper feed cassette 12 are taken out one by one and conveyed through the conveying path 19, during which time an image is printed on the front side (the upper side in FIG. 1) of the paper sheet using the image forming section 20 and the fixing device 18. The front side printed paper sheet is discharged onto the upper paper discharge tray 21 or the side paper discharge tray 22.

At step S35, it is judged whether the front side printing ends or not. When if the front side printing ends, it is judged according to the ON/OFF state of the paper detecting switch 24 whether a paper sheet is present on the manual paper feed tray 23 or not (step S36).

When the presence of a paper sheet on the manual paper feed tray 23 is detected, this paper sheet is one having been set and left on the manual paper feed tray 23 and is not the one side printed paper sheet, so that a message meaning "Remove the paper sheet from the manual paper feed tray and then set the front side printed paper sheet thereon" is displayed on the display section 27 and the display panel of the personal computer 2 (step S37). When the user sees the display and removes the paper sheet from the manual paper feed tray 23, the state of the paper detecting switch 24 changes and thereby it is detected that the paper sheet on the manual paper feed tray 23 is removed (step S38).

When no paper sheet is present on the manual paper feed tray 23 at step 36, or the paper sheet on the manual paper feed tray is removed at step S38, the program proceeds to step S39 and a message meaning "Set the paper sheet for the back side printing (the front side printed paper sheet) and press the OK button (operation button) 28" is displayed on the display section 27 and the display panel of the personal computer 2 (step S39).

After confirming that the front side printed paper sheet for the back side printing is set on the manual paper feed tray 23 (step S40), and that the OK button (operation button) 28 is pressed (step S41), the control section 31 takes the paper sheet from the manual paper feed tray 23 one by one, executes the back side printing and discharges the back side printed paper sheet onto the upper paper discharge tray 21 or the side paper discharge tray 22 (step S42).

Since the abovementioned control is executed in the printer 1 according to this invention, it is necessary for a user to set the discharged paper sheet onto the manual paper feed tray 23 of the printer 1 not provided with a two-sided printing mechanism, but it is a simple operation and the two-sided printing can be surely executed.

Especially in the case that another paper sheet is present on the manual paper feed tray 23, the two-sided printing is not executed till the paper sheet is removed and the proper front side printed paper sheet is set thereon, so that the printer is free from erroneous printing.

A printer is described as an example in the abovementioned embodiments. However, if a user wants to copy a read-out manuscript on the two sides of a paper sheet using a copying machine, the two-sided copying can be surely executed by the abovementioned control.

The present invention is not limited to the abovementioned embodiments but can be variously modified within the scope of the claims.

What is claimed is:

1. In an image forming apparatus having no two-sided printing mechanism for reversing a paper sheet and automatically printing on two sides of the paper sheet, an image forming apparatus comprising:

a means for setting a two-sided printing instruction to print on both of front and back sides of a paper sheet and a two-sided printing mode not accepting any other data than given data, in response to printing data being given;

a front side printing executing means for printing front side printing data among the given printing data on the paper sheet and discharging the printed paper sheet to the outside of the apparatus in the two-sided printing mode;

an OK signal detecting means for detecting a signal indicating a user's approval of executing predetermined assisting actions after the two-sided printing mode is set;

a time measuring means for starting time measurement at the end of printing executed by the front side printing means, in response to the OK signal detecting means detecting the signal;

a means for detecting whether a paper sheet has been set in a predetermined paper feed section or not by the time the measuring means measures a predetermined time;

a back side printing executing means for taking a paper sheet in response to the paper detecting means detecting that the paper sheet is set, printing back side printing data among the given printing data on the paper sheet and discharges the printed paper sheet to the outside of the apparatus; and a means for releasing the set two-sided printing mode, when a paper sheet has not been set in the predetermined paper feed section by the time the measuring means measures the predetermined time.

2. An image forming apparatus according to claim 1, wherein the back side printing executing means executes the printing in response to a signal for starting the back side printing being given in addition to the detection of the paper sheet being set in the predetermined paper feed section.

3. An image forming apparatus according to claim 1 being connectable to a personal computer, wherein the two-sided printing instruction, the printing data and the OK signal are given from the connected personal computer.

4. In an image forming apparatus connected to a personal computer and having no two-sided printing mechanism for reversing a paper sheet and automatically printing on two sides of the paper sheet, a printing control method comprising the steps of:

setting in response to that a two-sided printing instruction to print on both of the front and back sides of the paper sheet and printing data are given from the personal computer to the image forming apparatus, the image forming apparatus to a two-sided printing mode not accepting any other printing data than a given data, executing the front side printing by printing front side printing data among the given printing data on the paper sheet and discharging the printed paper sheet to the outside of the apparatus;

detecting that a predetermined OK signal is given from the personal computer after setting the two-sided printing mode, and starting time measurement at the end of the front side printing;

executing the back side printing, when the paper sheet is set in a predetermined paper feed section before the measuring time is over a predetermined time, by printing back side printing data among the given printing data on the set paper sheet and discharging the printed paper sheet to the outside of the apparatus; and releasing the set two-sided printing mode when the paper sheet is not set in the predetermined paper feed section before the measuring time is over the predetermined time.

5. In an image forming apparatus having no two-sided printing mechanism for reversing a paper sheet and automatically printing on two sides of the paper sheet, an image forming apparatus comprising:

a means for setting a two-sided printing instruction to print on both of the front and back sides of the paper sheet and a two-sided printing mode not accepting any other data than given data, in response to printing data being given;

a front side printing executing means for printing front side printing data among the given printing data on the paper sheet and discharging the printed paper sheet to the outside of the apparatus in the two-sided printing mode;

an OK signal detecting means for detecting a signal indicating a user's approval of executing predetermined assisting actions after the two-sided printing mode is set;

a time measuring means for starting time measurement at the end of printing executed by the front side printing means, in response to the OK signal detecting means detecting the signal;

a means for detecting whether a paper sheet has been set in a predetermines paper feed section or not by the time the measuring means measures a predetermined first time;

a back side printing executing means for taking a paper sheet in response to the paper detecting means detecting that the paper sheet is set, printing back side printing data among the given printing data on the paper sheet and discharges the printed paper sheet to the outside of the apparatus;

a two-sided printing mode interrupting means for interrupting the two-sided printing mode, enabling to print other data than the given printing data and waiting restoration of the two-sided printing mode, when the paper sheet has not been set in the predetermined paper feed section by the time the measuring means completes measuring the predetermined first time; and a restoring means for restoring the two-sided printing mode, when a signal to print back side printing data among the given printing data is given by the time the measuring means completes measuring a predetermined second time longer than the first time.

6. An image forming apparatus according to claim 5, wherein the restoring means includes an informing means for informing necessary operations or actions to a user after restoring the two-sided printing mode.

7. An image forming apparatus according to claim 5 being connectable to a personal computer, wherein the two-sided printing instruction, the printing data and the OK signal are given from the connected personal computer.

8. In an image forming apparatus connected to a personal computer and having no two-sided printing mechanism for reversing a paper sheet and automatically printing on two sides of the paper sheet, a printing control method comprising the steps of:

setting in response to that a two-sided printing instruction to print on both of the front and back sides of the paper sheet and printing data are given from the personal computer to the image forming apparatus, the image forming apparatus to a two-sided printing mode not accepting any other printing data than a given data;

executing the front side printing by printing front side printing data among the given printing data on the paper sheet and discharging the printed paper sheet to the outside of the apparatus;

detecting that a predetermined OK signal is given from the personal computer after setting the two-sided printing mode, and starting time measurement at the end of the front side printing;

executing the back side printing, when the paper sheet is set in a predetermined paper feed section before the measuring time is over a predetermined time, by printing back side printing data among the given printing data on the set paper sheet and discharging the printed paper sheet to the outside of the apparatus;

interrupting the set two-sided printing mode, when the paper sheet is not set in the predetermined paper feed section before the measuring time is over the predetermined first time; and waiting in a state where the interrupted two-sided printing mode is restorable and at the same time printing other data than the given printing data is possible during the time after the measuring time is over the predetermined first time and before it is over a predetermined second time which is longer than the first time.

* * * * *